US006502634B1

(12) United States Patent
Evans et al.

(10) Patent No.: US 6,502,634 B1
(45) Date of Patent: Jan. 7, 2003

(54) INTERFACE MONITORING PLACEMENT SYSTEM

(75) Inventors: Michael Evans, Lagos (NG); Andrew Penno, Lagos (NG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/809,482

(22) Filed: Mar. 15, 2001

Related U.S. Application Data

(60) Provisional application No. 60/190,236, filed on Mar. 17, 2000.

(51) Int. Cl.[7] ..... E21B 47/06

(52) U.S. Cl. ..... 166/250.03; 166/279; 166/305.1; 166/66

(58) Field of Search ..... 166/250.03, 279, 166/288, 305.1, 306, 66

(56) References Cited

U.S. PATENT DOCUMENTS 3,990,304 A * 11/1976 Roesner ..... 73/151

OTHER PUBLICATIONS

Halliburton—Memorandum Regarding Placement Techniques.
Cardinal Surveys Company—Gamma Trol.
Cardinal Surveys Company—Controlled Interface Treatment Log.

* cited by examiner

*Primary Examiner*—William Neuder
(74) *Attorney, Agent, or Firm*—Conley, Rose & Tayon, P.C.

(57) ABSTRACT

The present invention relates generally to the treating of wells, and more particularly to a method and device that are capable of detecting the position of a fluid interface so that a well treatment can be placed with greater along hole depth precision in a given hydrocarbon producing well than previously. More particularly, an embodiment of the invention includes a method for accurately placing a well treatment fluid in a well, comprising: pumping a first fluid into a first part of the well until an interface is formed between the first fluid and a second fluid; extracting information regarding at least one fluid property of the first and second fluids with first and second to sensors positioned in the first and second fluids respectively; and exchanging information between the first and second sensors and a telemetry unit. The invention also includes a downhole tool for positioning a fluid interface in a well bore, comprising: first and second sensors, the spacers being spaced apart such that they span the fluid interface; the first sensor measures a first fluid property and the second sensor measures a second fluid property; a first fluid port on the same side of the first sensor as the spacer and in fluid communication with a first fluid flow line; and a second fluid port on the opposite side of the first sensor as the spacer and in fluid communication with a second fluid flow line.

71 Claims, 1 Drawing Sheet

INTERFACE MONITORING PLACEMENT SYSTEM

CROSS REFERENCE TO RELATED APPLICATIONS

The present application claims priority under 35 U.S.C. §119(*e*) of the benefit of 35 U.S.C. § 111(*b*) provisional application Serial No. 60/190,236 filed Mar. 17, 2000 and entitled "Interface Monitoring Placement System," application Ser. No. 60/190,236 hereby incorporated herein by reference.

FIELD OF THE INVENTION

The present invention relates generally to the treating of wells, and, in a more particular embodiment, to a method and apparatus for accurately placing a well treatment fluid in a a hydrocarbon-producing well. The present invention relates to a downhole device that is capable of detecting the position of a fluid interface so that a well treatment can be placed with greater along hole depth precision in a given well.

BACKGROUND OF THE INVENTION

A variety of well treatments using treating fluids are performed in the completion and stimulation of oil and gas wells. These treatments include, but are not limited to: well remediation, non-damaging kill fluids, water abatement with polymerizing gels, water abatement by relative permeability reduction, gas abatement with foams and gelled foams, clay stabilization, scale inhibition, wax deposition and removal, and hydraulic fracture treatments. Depending on the purpose of the treatment, the treating fluid may or may not be applied along the entire length (depth) of the well. In instances where the purpose of the treatment is to cause a change in only a localized region along the depth of the well, it is desirable to limit contact between the treating fluid and the rest of the formation.

For example, cementing treatments are carried out in the construction and repair of wells utilizing a cement composition as the treating fluid. In forming a cement composition, a hydraulic cement is normally mixed with water and other additives to form a pumpable cement composition that is placed in a subterranean zone that is penetrated by well bore. After placement in the zone, the cement composition sets into a hard, substantially impermeable mass within the zone.

The most common cementing treatment or operation performed in the construction of a well is primary cementing, wherein a metal pipe string, such as casing or a liner, is placed in the well bore and bonded therein by cement. Other cementing treatments utilized in wells are usually remedial in nature. For example, a cement composition is often squeezed into cracks or openings in pipe disposed in the well bore, in the cement sheath in the annulus between the pipe and the well bore, and in other similar locations and allowed to set, so that the cracks or openings are plugged.

High viscosity well treating fluids are also utilized in well completions and in the stimulation of formations penetrated by the well bore to enhance the production of oil and gas therefrom. The most common of such treating fluids are high viscosity gelled fluids that are utilized in completion treatments, such as in forming gravel packs, and stimulation treatments, such as hydraulic fracturing.

Hydraulic fracturing is performed by injecting a high viscosity fluid through the well bore into the subterranean formation that is to be fractured and applying sufficient fluid pressure on the formation to cause its breakdown and the production of one or more fractures therein. A fracture proppant material, such as sand or other particulate material, is usually suspended in the high viscosity fracturing fluid so that the proppant material is carried into the fractures and deposited therein. When pressure on the fractured formation is released, the fractures are propped open by the proppant material therein.

Another instance in which it is desired to treat a specific portion of the formation is in wells that have a significant water production. While the oil well is usually completed so as to draw from an oil-bearing zone, in wells where there is a water bearing zone adjacent to the oil zone or there is a water drive mechanism, the water often flows into the well by way of natural fractures, coning, bottom or edge water encroachment, channels behind pipe and high permeability streaks in the formation. In the production of such wells, the ratio of water to oil recovered may become so high that the cost of producing the water, separating the water from the produced oil and disposing of the water represents a significant economic loss.

It is known to use cross-linking aqueous polymer solutions to reduce the production of water from such wells. According to common practice, an aqueous polymer solution is pumped into the water bearing portion of the formation. The polymer solution then crosslinks so that it forms a stiff gel. The gel plugs the natural fractures, intergranular porosity, channels and high permeability streaks through which water would otherwise flow into the wellbore. An example of such process can be found in U.S. Pat. No. 5,181,568, hereby incorporated herein by reference.

Because a water reduction treatment using an aqueous polymer solution results in the permanent permeability reduction of the formation, it is imperative that the permeability in the oil zone is not reduced as this will potentially destroy all oil production. Furthermore, the relatively large volumes of aqueous polymer solution required for performing the heretofore used polymer water reduction treatments causes the treatments to be very expensive. Thus, there is a need for an improved method of selectively placing these permeability reducing treatments in a subterranean oil bearing formation that has started to produce water without incurring the above mentioned problems and high cost.

In all of the various completion and stimulation treatments where a treating fluid is introduced into a subterranean zone penetrated by a well bore, it is difficult to confirm whether and to what degree the treating fluid has entered the desired subterranean zone. In particular, when it is desired to apply a treatment to only a specific portion of the formation, it is difficult to direct the treatment to the specific portion. While it is possible to treat the entire well for the purpose of treating the specific portion, it is sometimes difficult to ensure that the subject zone has received any treatment at all. For example, when the purpose of a treatment, such as acidizing, is to increase the permeability of a relatively impermeable layer in the formation, the low permeability of that layer prior to treatment will limit effectiveness of the treatment on that stratum. On the other hand, because of their relative permeability, the other portions of the formation, which were already sufficiently permeable, are likely to be contaminated or otherwise affected by the treatment fluid.

It is possible to isolate the formation layer that is to be treated so that the treating fluid only contacts that layer. This may require the use of packers above and below the layer in question. These packers can be run on coiled tubing or standard tubulars. The packer is placed between the casing and tubular. Placement of such packers is time-consuming, increases the complexity and is expensive, with the packers themselves adding to the cost of the operation. Also, packers have coherent technical limitations and may cause problems going through and coming back through restrictions.

Partly in response to this problem, significant time and energy has gone into the development of methods for detecting the locations of a well treating fluid as it is being introduced into a well. In one common practice, a radioactive tracer material is included in the protection fluid or treating fluid. During the placement of the protection fluid or treating fluid containing the radioactive tracer, an instrument that detects radioactivity is included on the coiled tubing or work string and is used to determine the location or locations of the protection fluid or treatment fluid.

Radioactive tracers are expensive and are considered hazardous. They and the fluids containing them must be handled and disposed of in accordance with the laws and rules relating to hazardous materials. These measurements of fluid placement, while somewhat accurate, are not entirely precise. Finally, even if packers are used to isolate a zone that is going to be treated, this may not help in certain kinds of completion such as gravel packs, where there is a fluid communication path through the gravel pack jacket, or in cases where there is a bad cement bond and a channel behind pipe.

Thus, there is a need for a relatively inexpensive, effective method of accurately placing a treating fluid in contact with a desired formation layer. It is preferred that the system not involve the use of radioactive tracer materials or other hazardous materials that require disposal of in a special manner.

SUMMARY OF THE INVENTION

The present invention provides a relatively inexpensive, effective method for accurately placing a treating fluid in contact with a desired formation layer. The present system does not involve the use of radioactive tracer materials or other hazardous materials that must be disposed of in a special manner, nor does it require the use of packers. Because it allows much more accurate placement of well treatments, the present invention provides an improved method for selectively reducing the permeability of water bearing subterranean formations at relatively low cost and without damaging the oil-producing zones of the formation.

More particularly, an embodiment of the invention includes a method for accurately placing a well treatment fluid in a well, comprising: pumping a first fluid into a first part of the well until an interface is formed between the first fluid and a second fluid; extracting information regarding at least one fluid property of the first and second fluids with first and second sensors positioned in the first and second fluids respectively; and exchanging information between the first and second sensors and a telemetry unit.

The invention also includes a downhole tool for positioning a fluid interface in a well bore, comprising: first and second sensors, the spacers being spaced apart such that they span the fluid interface; the first sensor measures a first fluid property and the second sensor measures a second fluid property; a first fluid port on the same side of the first sensor as the spacer and in fluid communication with a first fluid flow line; and a second fluid port on the opposite side of the first sensor as the spacer and in fluid communication with a second fluid flow line.

BRIEF DESCRIPTION OF THE DRAWINGS

For a better understanding of the embodiments described below, reference will be made to the accompanying Figures, wherein.

Figure 1:
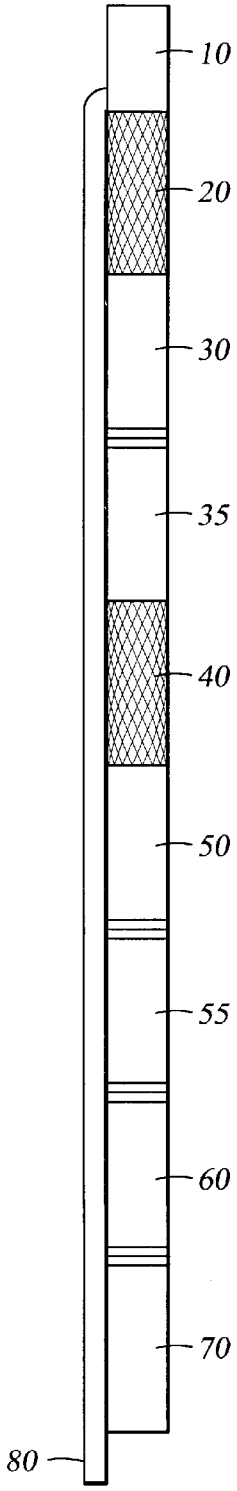
FIG. 1 is a schematic side view of a tool constructed in accordance with a preferred embodiment of the present invention.
Figure 2:
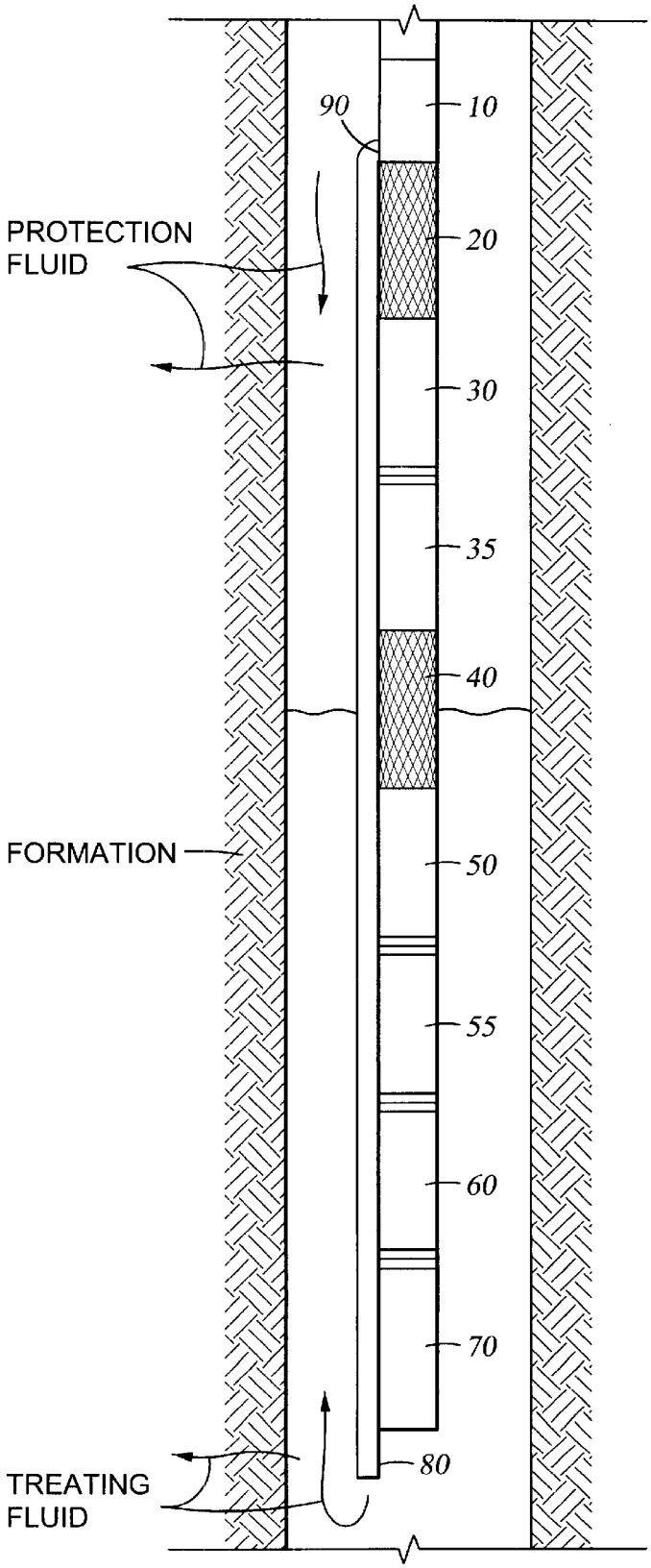
FIG. 2 is a schematic view of a preferred embodiment in a wellbore undergoing treatment facilitated by the tool of FIG. 1.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE PREFERRED EMBODIMENTS

The present invention provides a downhole tool that both detects the position of a fluid interface in a well. The present invention can also provide a fluid bypass line that allows the interface to be maintained at a desired position. Referring initially to FIG. 1, a preferred embodiment of the present interface monitoring tool includes a ported coiled tubing electric line logging head 10, a telemetry/GR/CCL unit 20, an upper fluid ID sensor 30, an upper fluid ID sensor 35, a spacer 40, a lower fluid ID sensor 50, a lower fluid ID sensor 55, a temperature sensor 60, a pressure sensor 70 and a coiled tubing extension tube 80.

The ported coiled tubing electric line logging head 10 is used to connect the sensor tools below it to the electric line/coiled tubing (not shown) that extends to the surface. Head 10 includes a port 90 that provides fluid communication between the bottom of the coiled tubing and the coiled tubing extension tube 80, so to facilitate fluid bypass into the tube conveying fluid to the bottom of the sensor string, as described below. Telemetry unit 20 is preferably normally located below head 10, but can be located at any point on the tool. Telemetry unit 20 can be any telemetry system, including a conventional telemetry system for transmitting data that is collected by the sensor string up hole via the electric line. Telemetry unit 20 includes a gamma ray tool and a casing collar locator (both not shown), both of which are known in the art and are required for accurate depth positioning and correlation during placement.

Upper fluid ID sensor 30 and upper fluid ID sensor 35 can each be either a nuclear fluid density sensor, dielectric sensor, manometer sensor, or any other available fluid identification sensor, such as a resistivity sensor. A manometer sensor is a fluid ID tool that measures the pressure difference over a certain distance on the tool body when immersed in a fluid and calculates the density of the fluid. At a minimum, the sensor should be capable of distinguishing between the two fluids whose interface is to be detected, such as a water-based fluid and an oil-based fluid. In some cases, the two fluids may have the same base, such as a water-based treating fluid and water-based heavy brine. Sensors having the desired capabilities are known in the art.

It is preferred but not necessary to provide a pair of sensors above and a pair of sensors below spacer 40 because some fluid ID sensors cannot make a sufficiently clear distinction between two fluids. Furthermore, it is preferred to provide alternative sensor types both above and below spacer 40. For example, in the case of two water-based fluids described above, dielectric fluid sensors would read the same, but nuclear fluid density sensors would be able to distinguish between 9 lb./gal. treating fluid and 12 lb./gal. brine. On the other hand, if the two fluids have similar densities, dielectric sensors may provide more useful information than nuclear fluid density sensors. Hence, it may be desired to include different types of sensor in each sensor pair. Also, having two sensors above and below the spacer also allows confirmation of the fluid type, thus giving a greater degree of confidence when both sensors respond well to each fluid type. It also shows rate of movement of the interface with surface pump rate.

Spacer 40 is located below fluid sensor 35 and serves to separate the upper and lower sets of fluid sensors. The length of spacer 40 may vary, depending upon the accuracy required of the vertical position of the interface of the two fluid systems. In a preferred embodiment, spacer 40 is at least 33 cm long, and may be as long as 300 cm if desired. A preferred length is 60 cm. Spacer 40 preferably comprises a standard electric line sinker bar with a feed-through conductor to allow the telemetry signal from the lower fluid ID tools and the pressure and temperature tools to enter the telemetry sub.

Like upper fluid ID sensors 30, 35, lower fluid ID sensors 50, 55, can each be either a nuclear fluid density, dielectric, manometer, resistivity, or any other suitable type of fluid ID sensor that is capable of distinguishing between the two fluids whose interface is to be detected.

In a preferred embodiment, a temperature sensor 60 is included to facilitate accurate formulation/fine tuning in the case of treating fluids having temperature-dependant gel times. The temperature in the placement zone is critical in designing the radial depth of treatment and also for efficient auto-diversion of the treatment during placement. Providing temperature data helps ensure effective treatment/water control. Similarly, the preferred tool includes a pressure sensor 70, which provides measured data on downhole treating pressure/reservoir pressure and friction pressure loss while pumping. This makes it possible to define when treatment is completed and also eliminates the possibility of exceeding the fracture pressure of the well, which would be detrimental to treatment effectiveness. Pressure sensor 70 and temperature sensor 60 can be located anywhere along the tool, but generally at the downhole end of the tool. Additionally, there is no requirement that temperature sensor 60 be located uphole from pressure sensor 70 as illustrated in FIG. 1.

Each of the sensors 30, 35, 50, 55, 60, and 70 is electrically or otherwise connected to telemetry unit 20 so as to enable the transmission of signals at least from each sensor to telemetry unit 20 and optionally from telemetry unit 20 to one or more of the sensors.

Lastly, a preferred embodiment includes coiled tubing extension tube 80, which extends from head 10 to a point below the lowermost component of the sensor assembly. The bottom of tube 80 preferably extends at least 30 cm below the bottom of the sensor assembly, and may in some instances extend to the bottom of the well. Extension tube 80 can be up to 200 cm long. Tube 80 provides a bypass for the treating fluids to be transported past the sensors 30, 35, and preferably past sensors 50, 55, so that the fluid identification sensors read only the treating fluid or protection fluid as it rises up from the bottom of the well. It is possible to place the treating fluid above the protection fluid by increasing the density of the protection fluid so it naturally segregates below the treatment fluid because of its higher density.

Before treatment, a well will typically be full of completion fluid or produced fluids. When it is desired to treat a well, the treating fluid is pumped into one part of the formation and the protection fluid is pumped simultaneously into another part of the formation, which will be at different depths in the well. The lighter fluid (protection or treatment) being pumped down the casing or tubing and the heavier fluid (protection or treatment) being pumped down the coiled tubing or tubular will form an interface in the casing as each fluid flows into the formation. In this case, the present tool is lowered into the hole and is positioned such that spacer 40 is positioned at the desired interface depth in the hole. In some cases, such as water control treatment, the desired interface depth will be either at the top or the bottom of a water-producing layer or stratum, depending upon the position of the oil layer.

For the case where the treating fluid is going to be placed below the protection fluid, the treating fluid is pumped into the well through the coiled tubing or tubulars until it reaches head 10. At head 10 it passes through the port 90 and into the top of coiled tubing extension tube 80. The treating fluid continues through the length of extension tube 80, until it exits at the bottom of tube 80. As the treating fluid flows into the well, it displaces the completion fluid in the well. If the treating fluid is more dense than the fluid in the well, as is typically the case, the treating fluid will flow to the bottom of the well and fill the well from the bottom. As the level of the treating fluid rises in the well, the fluid interface between the treating fluid rises until it reaches the depth at which the tool is positioned. As the level passes sensors 55 and 50, each senses the presence of the treating fluid and transmits an appropriate signal to the surface via telemetry unit 20. At the same time, sensors 30, 35 sense the presence of the protection fluid. Once the fluid interface rises past spacer 40, treating fluid will be sensed at sensor 35. Once this occurs, the rate at which the treating fluid is pumped into the coiled tubing, is decreased to correspond to the rate at which the treatment fluid flows into the formation. If necessary to lower the interface, pressure can be incrementally increased on the protection fluid, so as to shift the fluid interface down to the level of spacer 40. Once the fluid interface is positioned as desired, the sensors continually monitor its level and communicate with the surface so that the fluid volumes and pressures can be controlled so as to keep the interface from shifting up or down from the desired level. If the coil tubing is run into the well through a tubing string, the protection fluid can be pumped into the well through the annulus between the coil tubing and the tubing string and can flow out of the well through the annulus between the tubing and the casing. Alternatively, the protection fluid can be pumped down the annulus between the casing and the coiled tubing.

Injecting the two fluids at different points ensures that the treating and protection fluid approach each other from opposite directions and establishes a clean interface, ensuring accuracy and clarity of data. The protection fluid, which can be either above or below the treating fluid, flows out into the formation as it is pumped and is pumped at a rate that maintains the interface at the desired position. The protection fluid will only flow out of the well after the gel has fully crosslinked and the well is put back on production. The interface detection tool is typically removed from the well before production resumes. In this manner, the invention allows accurate vertical positioning of the interface of the two fluid systems, which is essential to effective placement of water control treatments.

While the foregoing description is given in terms of a water control treatment, in which the treating fluid is denser than the protection fluid and occupies the bottom of the wellbore, it will be understood that the relative densities of the treating and protection fluid can be varied, and that the tool can be used to perform operations in which the relative positions of the fluids are reversed.

Similarly, while an embodiment of the tool having two sets of sensors, a single spacer, and a single fluid conduit and bypass line is described above, the invention includes tools having three or more sets of sensors, two or more spacers, and two or more fluid conduits and bypass lines of differing length. By increasing the number of sensors, spacers, conduits and bypass lines, the number of fluid interfaces that can be detected and accurately positioned increases correspondingly.

The system of placement of fluids, which utilizes production logging sensors configured in a certain way in combination with a bypass tube, is a more accurate method of monitoring the position of the interface between two dissimilar fluids than has heretofore been known because it allows accurate placement of treatments at a defined depth. The system provides two or more spaced-apart fluid sensors, which can span the fluid interface. In contrast, previous systems that provided only a single sensor could only provide a single point of data and thus could not accurately position the interface. Hence, the sensor string of the system, in combination with the density contrast treating fluid systems, facilitates an accuracy of treatment that has not been feasible to date.

The Figures depict a configuration of sensor string for a simple lower zone treatment having just an upper and lower set of sensors between which is a spacer. The sensor string could potentially include another set of sensors and a spacer. By increasing the number of fluid identification sensors by two and adding another spacer, it is possible under certain completion configurations to control two interfaces resulting from using three dissimilar fluids. For example, it may be desired to treat a water zone bounded by two hydrocarbon zones.

What is claimed is:

1. A method for positioning a fluid interface in a well, comprising:

(a) providing a tool comprising:

(i) a spacer having first and second ends;

(ii) a first sensor adjacent to the first end of the spacer, wherein the first sensor measures a first fluid property; and (iii) a second sensor adjacent to the second end of the spacer, wherein the second sensor measures a second fluid property;

(b) collecting from the first and second sensors information indicative of the properties of the fluid adjacent to each of the first and second sensors, respectively; and (c) comparing the information collected from the first and second sensors.

2. The method according to claim 1, wherein the first and second sensors measure the same fluid property.

3. The method according to claim 1, wherein the tool further comprises a third sensor.

4. The method according to claim 3, wherein the tool further comprises a fourth sensor.

5. The method according to claim 1, wherein the tool further comprises a telemetry unit positioned at any point along the tool.

6. The method according to claim 5, further comprising the step of communicating the information collected-from the first and second sensors to the telemetry unit.

7. The method according to claim 1, wherein the tool further comprises a head located above the first and second sensors.

8. A method for positioning a fluid interface in a well, comprising:

(a) providing a tool comprising:

(i) a spacer having first and second ends;

(ii) a first sensor adjacent to the first end of the spacer, wherein the first sensor measures a first fluid property;

(iii) a second sensor adjacent to the second end of the spacer, wherein the second sensor measures a second fluid property; and (iv) a third sensor and a fourth sensor; wherein the third sensor is on the same side of the spacer as the first sensor and the fourth sensor is on the same side of the spacer as the second sensor and wherein the first and second sensors measure the same fluid property and the third and fourth sensors measure a different fluid property;

(b) collecting from the first and second sensors information indicative of the properties of the fluid adjacent to each of the first and second sensors, respectively; and (c) comparing the information collected from the first and second sensors.

9. A method for positioning a fluid interface in a well, comprising:

(a) providing a tool comprising:

(i) a spacer having first and second ends;

(ii) a first sensor adjacent to the first end of the spacer, wherein the first sensor measures a first fluid property;

(iii) a second sensor adjacent to the second end of the spacer, wherein the second sensor measures a second fluid property; and (iv) a head located above the first and second sensors;

(b) collecting from the first and second sensors information indicative of the properties of the fluid adjacent to each of the first and second sensors, respectively; and (c) comparing the information collected from the first and second sensors;

wherein the head includes an extension tube having an upper end and a lower end, the upper end being above the first and second sensors and the lower end being below the first and second sensors.

10. The method according to claim 9, further comprising the step of sufficiently pumping a first fluid into the well via the extension tube to contact a second fluid within the well, creating an interface between the first and second fluids.

11. The method according to claim 10, wherein the step of pumping further comprises pumping the first fluid until the interface passes the second sensor.

12. The method according to claim 11, wherein the step of pumping further comprises pumping the first fluid until the interface passes the spacer.

13. The method according to claim 12, wherein the first fluid is a treatment fluid.

14. The method according to claim 13, wherein the step of pumping further comprises pumping the treatment fluid until the first sensor detects the treating fluid.

15. The method according to claim 13, further comprising the step of decreasing rate of pumping of the treatment fluid to correspond substantially to the rate at which the treatment fluid flows into the formation and pumping the treatment fluid to substantially maintain the interface between the first and second sensors.

16. A method for positioning a fluid interface in a well, comprising:

(a) providing a tool comprising:

(i) a spacer having first and second ends;

(ii) a first sensor adjacent to the first end of the spacer, wherein the first sensor measures a first fluid property; and (iii) a second sensor adjacent to the second end of the spacer, wherein the second sensor measures a second fluid property;

(b) collecting from the first and second sensors information indicative of the properties of the fluid adjacent to each of the first and second sensors, respectively;

(c) comparing the information collected from the first and second sensors;

(d) pumping a first fluid and a second fluid into the well; and (e) using the information obtained in step (c) to control the rates at which said first and second fluids are pumped into the well.

17. A method for accurately placing a well treatment fluid in a well, comprising:

(a) pumping a first fluid into a first part of the well until an interface is formed between the first fluid and a second fluid;

(b) extracting information regarding at least one fluid property of the first and second fluids with first and second sensors positioned in the first and second fluids respectively; and (c) exchanging information between the first and second sensors and a telemetry unit.

18. The method according to claim 17, further comprising the step of maintaining the position of the interface at a desired position in the well by adjusting the pressure applied to the first or second fluids and by monitoring the position of the interface within the well.

19. The method according to claim 17, wherein step (c) further comprises transmitting information regarding the at least one fluid property from the first and second sensors to the telemetry unit.

20. A method for positioning a fluid interface at a desired interface depth in a well, comprising:

(a) positioning a tool proximate the desired interface depth in the well, the tool comprising a first sensor and a second sensor, the first sensor being positioned above the desired interface depth and the second sensor being positioned below the desired interface depth;

(b) forming an interface between first and second fluids;

(c) analyzing at least one property of the first and second fluids with the first and second sensors to acquire information;

(d) pumping a first fluid and a second fluid into the well; and (e) controlling the rate at which said first and second fluids are pumped by using the information acquired in step (c).

21. The method according to claim 20, wherein said step of forming an interface further comprises injecting the first and second fluids at different points in the well.

22. The method according to claim 20, wherein the tool further comprises a third sensor on the same side of the spacer as the first sensor and a fourth sensor on the same side of the spacer as the second sensor, wherein the first and second sensors measure the same fluid property and the third and fourth sensors measure the same property, but a property different than the first and second sensors measure.

23. The method according to claim 20, wherein the tool further comprises first and second fluid ports, said first fluid port communicating with the well below the desired interface depth and said second fluid port communicating with the well above the desired interface depth; and wherein the step of forming an interface further comprises pumping the first and second fluids through the first and second ports, respectively.

24. The method according to claim 20, wherein said step of controlling further comprises decreasing the rate at which the first fluid is pumped to correspond to the rate at which the first fluid flows into the formation.

25. A downhole tool for positioning a fluid interface in a well bore, comprising:

first and second sensors, said sensors being spaced apart such that they span the fluid interface;

said first sensor measures a first fluid property and said second sensor measures a second fluid property;

a spacer disposed on the tool;

a first fluid port on the same side of said first sensor as said spacer and in fluid communication with a first fluid flow line; and a second fluid port on the opposite side of said first sensor as said spacer and in fluid communication with a second fluid flow line.

26. The downhole tool according to claim 25, wherein said first and second properties are the same.

27. The downhole tool according to claim 26, further comprising a third sensor disposed on the same side of the span as said first sensor.

28. The downhole tool according to claim 27, further comprising a fourth sensor disposed on the same side of the span as said second sensor.

29. The downhole tool according to claim 28, wherein said first and second properties are different and said third sensor measures said second property and fourth sensor measures said first property.

30. The downhole tool according to claim 25, further comprising a fluid bypass line having first and second ends, said first end of said line disposed on the same side of the span as said first sensor and said second end of said line disposed on the same side of the span as said second sensor.

31. The downhole tool according to claim 25, further comprising a telemetry unit in communication with said first and second sensors.

32. The downhole tool according to claim 25, further comprising a spacer positioned in the span between said first and second sensors.

33. The downhole tool according to claim 32, wherein said spacer is between about 33 centimeters long and about 300 centimeters long.

34. The downhole tool according to claim 32, wherein said spacer is approximately 60 centimeters long.

35. The downhole tool according to claim 25, further comprising a temperature sensor.

36. The downhole tool according to claim 35, further comprising a pressure sensor.

37. The downhole tool according to claim 25, further comprising a controller controlling flow through said first and second fluid flow lines in response to information received from said first and second sensors.

38. The tool according to claim 25, wherein said first and second sensors are resistivity sensors.

39. The tool according to claim 25, wherein said first and second sensors are density sensors.

40. A tool for treating a well, comprising:

a spacer having a first end and a second end;

first means for identifying a first property of a fluid, said first means for identifying being disposed proximate said first end of said spacer;

second means for identifying a second property of a fluid, said second means for identifying being disposed proximate said second end of said spacer; and means for receiving data gathered by said first and second means for identifying, said means for receiving in communication with said first and second means for identifying.

41. The tool according to claim 40, wherein said means for receiving data is a telemetry unit.

42. The tool according to claim 40, further comprising a third means for identifying a third fluid property and a fourth means for identifying a fourth fluid property, said third means for identifying being disposed proximate said first end of said spacer and said fourth means for identifying being disposed proximate said second end of said spacer.

43. The tool according to claim 42, wherein said first and second means for identifying are first and second sensors, respectively.

44. The tool according to claims 43, wherein said third and fourth means for identifying are third and fourth sensors, respectively.

45. The tool according to claim 40, wherein said first property of a fluid is the same property as said second property of a fluid.

46. A tool for treating a well, comprising:

a spacer having a first end and a second end;

first means for identifying a first property of a fluid, said first means for identifying being disposed proximate said first end of said spacer;

second means for identifying a second property of a fluid, said second means for identifying being disposed proximate said second end of said spacer;

means for receiving data gathered by said first and second means for identifying, said means for receiving in communication with said first and second means for identifying; and means for moving a well treatment fluid past said second means for identifying.

47. The tool according to claim 46, herein said means for moving further moves the well treatment fluid past said spacer.

48. The tool according to claim 47, wherein said means for moving further moves the well treatment fluid past said first means for identifying.

49. A tool for treating a well, comprising:

a spacer having a first end and a second end;

first means for identifying a first property of a fluid, said first means for identifying being disposed proximate said first end of said spacer;

second means for identifying a second property of a fluid, said second means for identifying being disposed proximate said second end of said spacer; and means for receiving data gathered by said first and second means for identifying, said means for receiving in communicating with said first and second means for identifying;

wherein said first fluid property and said second fluid property are different fluid properties.

50. A tool for treating a well, comprising:

a spacer having a first end and a second end;

first means for identifying a first property of a fluid, said first means for identifying being disposed proximate said first end of said spacer;

second means for identifying a second property of a fluid, said second means for identifying being disposed proximate said second end of said spacer;

means for receiving data gathered by said first and second means for identifying, said means for receiving in communication with said first and second means for identifying;

a third means for identifying a third fluid property and a fourth means for identifying a fourth fluid property, said third means for identifying being disposed proximate said first end of said spacer and said fourth means for identifying being disposed proximate said second end of said spacer;

wherein said first and second means for identifying are first and second sensors, respectively;

wherein said third and fourth means for identifying are third and fourth sensors, respectively; and wherein said first and third sensors are different types of sensors and said second and fourth sensors are different types of sensors.

51. A downhole tool for positioning a fluid interface in a well bore, comprising:

a plurality of sets of sensors, each of said sets comprising at least first and second sensors, and each of said sets measuring a different fluid property;

at least one spacer for each, of said sets of sensors, each of said sets of sensors being separated by at least one of said spacers; and a means for reporting the measurements taken by each of said first and second sensors.

52. A downhole tool for positioning a fluid interface in a well bore, comprising:

a plurality of sets of sensors, each of said sets comprising at least first and second sensors, and each of said first and second sensors measuring a distinct fluid property at least one spacer for each of said sets of sensors, each of said sets of sensors being separated by at least one of said spacers;

a means for reporting the measurements taken by each of said first and second sensors; and a first fluid conduit having uphole and downhole ends, said uphole end coupled, directly or indirectly, to the surface and said downhole end extending below the furthest downhole set of sensors.

53. A downhole tool for locating a well treatment fluid in a well, comprising:

a head having a port;

a spacer located downhole from said head;

at least one upper sensor capable of distinguishing between fluids, each of said at least one upper sensor located downhole from said head and uphole from said spacer;

at least one lower sensor capable of distinguishing between fluids, each of said at least one lower sensor located downhole from said spacer; and a telemetry unit coupled to said upper and lower sensors.

54. The tool according to claim 53, wherein said coupling between said telemetry unit and said upper and lower sensors is an electrical connection.

55. The tool according to claim 53, wherein said telemetry unit receives signals from said upper and lower sensors.

56. The tool according to claim 53, wherein said upper and lower sensors are resistivity sensors.

57. The tool according to claim 53, wherein said upper and lower sensors are density sensors.

58. The tool according to claim 53, wherein said upper and lower sensors are dielectric sensors.

59. The tool according to claim 53, wherein said upper and lower sensors are manometer sensors.

60. A downhole tool for locating a well treatment fluid in a well, comprising:

a head having a port;

a spacer located downhole from said head;

at least one upper sensor capable of distinguishing between fluids, each of said at least one upper sensor located downhole from said head and uphole from said spacer;

at least one lower sensor capable of distinguishing between fluids, each of said at least one lower sensor located downhole from said spacer;

a telemetry unit coupled to said upper and lower sensors; and a passage having an upper end and a lower end, said upper end coupled to said port and said lower end extending at least below the lowermost of said at least one lower sensor.

61. A downhole tool for locating a well treatment fluid in a well, comprising:

a head having a port;

a spacer located downhole from said head;

at least one upper sensor capable of distinguishing between fluids, each of said at least one upper sensor located downhole from said head and uphole from said spacer;

at least one lower sensor capable of distinguishing between fluids, each of said at least one lower sensor located downhole from said spacer;

a telemetry unit coupled to said upper and lower sensors; and a pressure sensor disposed along the tool.

62. The tool according to claim 61, further comprising a temperature sensor disposed along the tool.

63. A method for placing an interface in a well hole, comprising:

(a) positioning a tool in the hole, the tool comprising:

(i) a spacer;

(ii) a first sensor;

(iii) a second sensor, the spacer located between the first and second sensors; and (iv) an extension tube having first and second ends, the first end of the extension tube being above the first and second sensors and the second end extending below the first and second sensors;

(b) forming an interface between a first fluid and a second fluid by pumping the first fluid through the extension tube;

(c) setting the desired location of the interface by obtaining data for at least a distinct property of the first and second fluids; and (d) maintaining the desired location of the interface using the data obtained in step (c).

64. The method according to claim 63, wherein the step of maintaining further comprises continually monitoring the desired level by obtaining data, communicating that data to the surface, and using the communicated data to adjust, combined or individually, the volumes and pressures of the first and second fluids to keep the interface from deviating too far from its desired level.

65. The method according to claim 63, wherein the first fluid is less dense than the second fluid.

66. The method according to claim 63, wherein the first fluid is a protection fluid and the second fluid is a treatment fluid.

67. A tool for positioning a plurality of fluid interfaces in a well, comprising:

at least three sensors, each of said sensors being capable of distinguishing between fluids;

at least two spacers each having first and second ends, each of said spacers having at least one of said sensors disposed at said first end and each of said spacers having at least one of said sensors disposed at said second end; and a means for collecting information from said sensors regarding distinguishing between fluids, said mean for collecting in communication with said sensors.

68. The tool according to claim 67, wherein said means for collecting is a telemetry unit.

69. A tool for positioning a plurality of fluid interfaces in a well, comprising:

at least three sensors, each of said sensors being capable of distinguishing between fluids;

at least two spacers each having first and second ends, each of said spacers having at least one of said sensors disposed at said first end and each of said spacers having at least one of said sensors disposed at said second end;

a means for collecting information from said sensors regarding distinguishing between fluids, said mean for collecting in communication with said sensors; and at least one fluid passage having a beginning and an end, said beginning disposed uphole from the furthest downhole of said sensors and said end disposed downhole from the furthest downhole of said sensors.

70. A tool for positioning a plurality of fluid interfaces in a well, comprising:

at least three sensors, each of said sensors being capable of distinguishing between fluids;

at least two spacers each having first and second ends, each of said spacers having at least one of said sensors disposed at said first end and each of said spacers having at least one of said sensors disposed at said second end; and a means for collecting information from said sensors regarding distinguishing between fluids, said mean for collecting in communication with said sensors;

wherein said spacer comprises a standard electric line sinker bar.

71. The tool according to claim 70, wherein said sinker bar has a feed-through conductor.

* * * * *